United States Patent [19]

Dietz et al.

[11] 4,452,642

[45] Jun. 5, 1984

[54] CLEANING OF METALLIC SURFACES WITH HYDROGEN UNDER VACUUM

[75] Inventors: Karl J. Dietz; François Waelbroeck, both of Jülich, Fed. Rep. of Germany

[73] Assignee: Kernforschungsanlage Jülich Gesellschaft mit beschränkter Haftung, Jülich, Fed. Rep. of Germany

[21] Appl. No.: 86,831

[22] Filed: Oct. 22, 1979

Related U.S. Application Data

[63] Continuation of Ser. No. 841,468, Oct. 12, 1977, abandoned.

[30] Foreign Application Priority Data

Oct. 19, 1976 [DE] Fed. Rep. of Germany ..... 2647288

[51] Int. Cl.[3] ..... B08B 5/04

[52] U.S. Cl. ..... 134/1; 134/2; 134/21

[58] Field of Search ..... 134/1, 2, 21

[56] References Cited

U.S. PATENT DOCUMENTS 2,985,756 5/1961 Holland ..... 134/1
3,868,271 2/1975 Poley et al. ..... 134/1

FOREIGN PATENT DOCUMENTS 10530 2/1908 Denmark ..... 134/2
1621650 2/1970 Fed. Rep. of Germany .
1521989 6/1971 Fed. Rep. of Germany .

OTHER PUBLICATIONS

Holland, L., "Vacuum Deposition of Films", John Wiley and Sons, Inc., 1956, N.Y., pp. 74–83, 86–97.

*Primary Examiner*—William F. Smith
*Attorney, Agent, or Firm*—Frishauf, Holtz, Goodman & Woodward

[57] ABSTRACT

Molecular hydrogen is caused to flow past a hot filament and then past an article having surfaces which are to be cleaned located in a vacuum chamber, at a pressure such that the mean free path of hydrogen molecules is less than the minimum space between the surfaces to be cleaned and the walls of the container. Some of the hydrogen molecules are converted by the hot filament into hydrogen atoms, which react with contaminants on the surface to be cleaned to form products that can be removed by the flow of gas. Other devices can be used for dissociating hydrogen flowing into the chamber into hydrogen atoms and/or ions. Cleaning is effective even on surfaces facing away from the location where the hydrogen atoms are formed.

7 Claims, 1 Drawing Figure

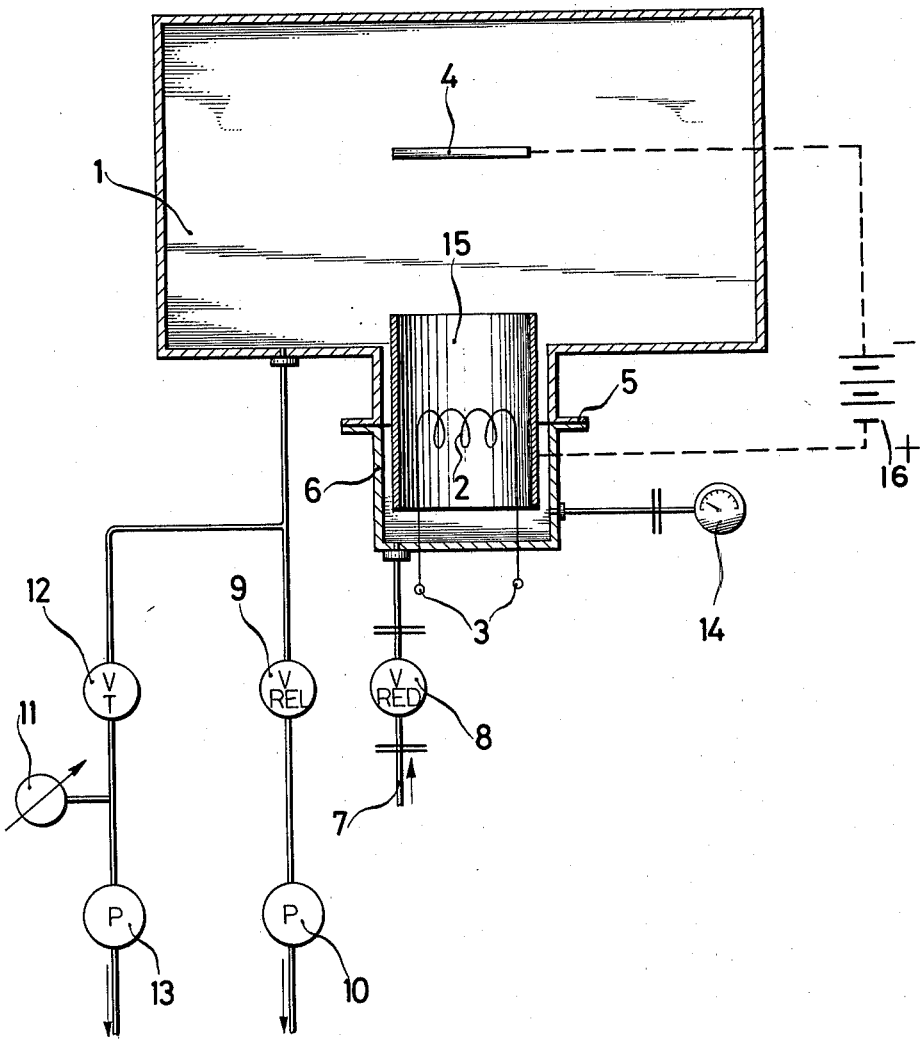
1
2
3
4
5
6
7
8
9
10
11
12
13
14
15
16
V T
V REL
V RED
P
P
−
+

CLEANING OF METALLIC SURFACES WITH HYDROGEN UNDER VACUUM

This is a continuation of application Ser. No. 841,468 filed Oct. 12, 1977, now abandoned.

This invention concerns a method and apparatus for cleaning surfaces, particularly metallic surfaces, to a high degree of cleanliness.

In vacuum technology, for example, very high requirements are imposed on the cleanliness of the inner surfaces of a vacuum vessel. Likewise, electrodes and other structures utilized in devices operating in vacuum or in controlled atmospheres may be required to have extremely clean surfaces.

Various procedures for cleaning of surfaces are known. One known cleaning process has the aim of assuring that the surface in question is free of fats. For this purpose water vapor at a temperature of about 120 degreee C. is passed over the surfaces to be cleaned (see "Die Fertigung Von CF-Flanschen," published in Leybold-Heraeus-Bericht, Bereich-WBF). It is also known to clean the surfaces of metallic workpieces by electrolytic attack or electrolytic polishing. Also well known for cleaning surfaces are processes using ultrasonic waves. All these known processes have the disadvantage that they are relatively expensive and are in general usable only before the assembly of apparatus that must be cleaned, so that cleaning after operational use, as it is often necessary, is no longer possible by these methods.

A different procedure is also known for cleaning of surfaces of small dimensions, such as are used in ultra-high vacuum technology and in surface physics. In this method the surfaces are subjected to heating to high temperatures of at least 700° C. This method is accordingly usable in practical operation only for highly localized cleaning. In particular, it cannot be carried out if it is a matter of handling larger surfaces or shaped surfaces, for example, containers, that are connected with other components. Another known method of cleaning of surfaces consists in bombarding the surfaces to be cleaned with ions, particularly argon ions, a method known under the name of "ion sputtering." These methods and likewise another known method in which cleaning is accomplished by chemical reaction with oxygen or hydrogen at temperatures lying above 700° C., are likewise only locally practical, that is, in the manner extending only over small regions. In chemical treatment with oxygen, moreover, the desired removal of the oxide layers thereby formed is not generally obtained. The disadvantages of these methods show up particularly when it is sought to use them to clean catalysts and to detoxify them.

THE PRESENT INVENTION

It is an object of the present invention to provide a method and apparatus making it possible to obtain very high degrees of cleanliness in cleaning surfaces by an economical treatment which is suitable for larger surfaces and also for surfaces of complicated shapes connected to other components. This object of the invention includes the cleaning of the inner surfaces of containers such as are used in vacuum technology and even in ultra-high vacuum technology.

Briefly, the surface to be cleaned is placed in a vacuum vessel in a position spaced from the walls thereof, through which vessel a stream of molecular hydrogen is passed to which the surfaces is exposed, while the pressure of the hydrogen is maintained within a range in which the free path of the hydrogen molecules is smaller than the smallest spacing between the surface to be cleaned and the oppositely lying wall of the vessel. While the hydrogen is thus flowing through the vessel, at least a part of the hydrogen molecules are converted into hydrogen atoms by means of contact with a hot material heated to a temperature above 1300° C. or by means of a high frequency coil and the hydrogen atoms react with the contaminating material on the surface to be cleaned, to produce reaction products that can be pumped out of the vessel with the exiting gas. Low energy hydrogen ions may also be formed and contribute to reactions. It is particularly desirable for the pressure of the molecular hydrogen flowing through the vessel to be such that $$\lambda \leqq d$$

in which expression $\lambda$ is the mean free path of the molecular hydrogen flowing through the vessel and d is the smallest spacing between the surface to be cleaned and the neighboring portion of the vessel walls, while the upper limit of the pressure is simply imposed by the necessity of keeping at a negligible value the recombination of hydrogen atoms into hydrogen molecules, a reaction that sets in at relatively higher pressures. In practice, for operation at room temperature and at a minimum spacing between the sources to be cleaned and the walls of the vacuum container of two or three centimeters, the pressure of the molecular hydrogen gas should be in the range between $10^{-3}$ mbar and 100 mbar and preferably between $10^{-2}$ mbar and 10 mbar and the rate of flow of hydrogen gas into the container should be at most 100 liters per second and preferably, for practical reasons, between 1 liter per second and 10 liters per second for a surface to be cleaned of 1 square meter.

The advantage of the procedure according to the invention consists in that all surface contaminations that undergo a combination reaction with atomic hydrogen or low energy hydrogen ions, as for example oxygen, carbon, nitrogen, chlorine, flourine, sulphur and even silicon, as well as other known materials and their compounds, are fully removed from the surface of the article to be cleaned by the present process, while the temperature of the article of which the surface is to be cleaned is not raised or, in any event, is only slightly increased, in the cases contemplated for practical operation. The economic nature of the method of the invention can be seen from the fact that quite high yield coefficients are found: for example, the yield coefficient in the conversion of carbon into methane or of metal oxide into water lies in the neighborhood of $10^{-3}$. Furthermore, there is the advantage that reaction products in gas form can be drawn off at room temperature. At the same time it is of course possible, in those cases in which a temperature rise can be tolerated, additionally to raise the temperature of the article to be cleaned, for example to a temperature up to 250° C., in order thereby to favor the desorption of the reaction products from the surface to be cleaned.

An apparatus for carrying out the process of the invention that has been found advantageous consists of a vacuum vessel in which, or in a space connected with the interior of which, is located a device for converting molecular hydrogen into hydrogen atoms or low energy hydrogen ions. Such a device is effectively provided by a heating surface of a material that does not react with hydrogen and is capable of being heated to a temperature lying above 1300° C. For such a heating surface the use of metals such as tungsten, molybdenum and rhodium and in particular cases also platinum, has been found effective. If a heating surface made of one of the materials just mentioned is heated to about 1770° C., hydrogen gas flowing through the vessel at a pressure of 0.1 mbar is disassociated to an extent reaching to more than 1%. At higher temperatures, the degree of dissociation was substantially higher.

At a hydrogen pressure of about $5 \cdot 10^{-1}$ mbar about $3 \cdot 10^{19}$ hydrogen atoms per second and per $cm^2$ of the heating surface were produced. The performance of the method of the invention at the above designated pressure is particularly suitable, because the recombination of hydrogen atoms in the gas phase is negligibly small at that pressure. It was found that for that reason a complete cleaning of the surface to be cleaned was obtained, because as a result of the convective or diffusive character of the flow of the atomic hydrogen, even the surface portions of the article to be cleaned facing away from the device for converting the molecular hydrogen into hydrogen atoms or low energy hydrogen ions were fully freed from their contaminations.

It has further been found that cleaning the wall surface of a vessel of about 6 liters capacity having an area of 2500 $cm^2$, with use of tungsten as the material for a heating surface, about 10 $cm^2$ heating surface was fully sufficient, with a treatment duration of about 10 minutes, to pass over into the gas phase a few monoatomic layers of contamination consisting of carbon and oxygen by a reaction with atomic hydrogen and then to remove the reaction products by pumping them away. In this case the throughput of the pump for sucking away the contaminants passing over to the gas atomsphere after the reaction at a pressure of 0.5 mbar was set at 1 liter per second. During the performance of the process the stainless steel vessel being cleaned was at the same time heated to a temperature of about 100° C.

It can also be advantageous to provide the device for converting molecular hydrogen into hydrogen atoms and/or low energy hydrogen ions in the form of an anode of a system for producing a glow discharge, and to connect the electric current source necessary for the anode and cathode operation to the surface to be cleaned in such a way that it becomes the cathode.

Along with such a device, or instead of it, it can also be useful to provide a coil excited with high frequency current for producing a corona discharge in the hydrogen gas. In that case it is advantageous for the high frequency coil to be made up of the same material as the vacuum vessel in which the surface to be cleaned is located. It may be convenient to provide the high frequency coil in such a form as to be usable if necessary as a resistance heater.

For carrying out the method of the invention a coil having a diameter of 19 cm and consisting of 12 turns of tungsten wire of 0.5 mm was used. The high frequency power was 18 watts at 28 MHz, the applied voltage was about 250 volts, and the currents were between 10 and 200 mA, depending upon the hydrogen pressure. In this case it was found that the discharge took place at hydrogen pressure between $10^{-3}$ and 1 mbar. It was further found that the effectiveness, compared with the use of a heating surface of the same dimension for the formation of methane, water and hydrogen sulphide from the contaminations leading to these reaction products by combination with hydrogen, was increased by the factor of 10. The reaction products were identified by means of a mass spectrometer.

Drawing, illustrating an example. The single FIGURE of the annexed drawing shows diagrammatically, with the principal portions in cross-section, an apparatus for carrying out the method of the invention.

A vacuum type container 1 has, projecting thereinto, a structure containing a heater wire of tungsten connected with external terminals for connection to a current source not shown in the drawing. The article or work piece that is to be cleaned is mounted in the container 1. The heating surface 2, which as shown is in the form of a filament, connected with the terminals 3 is mounted in a protective cap 6 that in operation is joined to the container 1 by means of a flange 5. A hydrogen supply container not shown in the drawing is connected to a hydrogen inlet pipe 7 that leads to the protective cap through a measuring valve 8 in such a way that the hydrogen flowing into the protective cap 6 and thence into the container 1 flows past the heating surface 2.

A pump 10 operating through a regulating valve 9 is provided for pumping off from the container 1 the contaminants formed out of atomic hydrogen and the original contamination and converted into the gas phase. A mass spectrometer 11 is provided for monitoring the degree of cleaning of the surface to be cleaned of the article 4 and is connected to the container 1 through a throttle valve 12 in such a way that a sufficient quantity of the gas stream is supplied by means of a pump 13 to the mass spectrometer for its monitoring operations. The pressure within the container 1 is continuously monitored by means of a pressure measuring device 14 connected to the protective cap 6. For promoting convection from the heating surface 2 in the protective cap 6 into the interior of the container 1 a short length of tube 15 is provided surrounding the heating surface 2 and open at both ends. The heating surface 2 is, as is evident from the drawing, also usable as a coil for high frequency current, so that the apparatus for performing the process of the invention is usable with resistance heating and/or with high frequency voltage.

A source of high voltage 16 is shown connected in broken lines with the tubular piece 15 and with the work piece 4 to symbolize the fact that the invention can also be carried out by applying an electric field between the article to be cleaned, as the cathode, and an anode to which sufficient voltage is provided to produce a glow discharge for converting molecular hydrogen into hydrogen atoms and/or low energy hydrogen ions.

Although the invention has been described in reference to a particular illustrative embodiment and particular process conditions, variations and modifications are possible within the invented concept.

We claim:

1. A method of cleaning surfaces, especially metallic surfaces, comprising the steps of:

heating the surface to be cleaned in a vacuum vessel to a temperature between 100° and 250° C.;

passing a stream of molecular hydrogen through the vacuum vessel so as to expose said surface thereto while maintaining the hydrogen gas pressure in said vessel at a value between a minimum pressure at which the mean free path of molecular hydrogen in the vessel is equal to the smallest spacing between the surface to be cleaned and the opposite wall of the vessel and a maximum pressure corresponding to a value that keeps the recombination of hydrogen atoms into hydrogen molecules at a negligible level;

converting at least part of the hydrogen molecules in said vessel into hydrogen atoms, thereby causing a subsequent chemical reaction of said hydrogen atoms with contaminations of said surface to produce gaseous reaction products; and pumping said reaction products out of said vessel with a vacuum pump.

2. A method of cleaning surfaces, especially metallic surfaces, comprising the steps of:

heating the surface to be cleaned in a vacuum vessel to a temperature between 100° and 250° C.;

passing a stream of molecular hydrogen through the vacuum vessel so as to expose said surface thereto while maintaining the hydrogen gas pressure in said vessel at a value between $10^{-3}$ and 100 mbar, while said surface is spaced by at least 2 cm from the opposite wall of said vessel;

converting at least part of the hydrogen molecules in said vessel into hydrogen atoms, thereby causing a subsequent chemical reaction of said hydrogen atoms with contaminations of said surface to produce gaseous reaction products; and pumping said reaction products out of said vessel with a vacuum pump.

3. A method as defined in claim 1 or claim 2 in which the hydrogen gas pressure in said vessel is maintained at a value between $10^{-2}$ and 10 mbar.

4. A method as defined in claim 1 or claim 2 in which the pumping speed controlling the pressure of the molecular hydrogen is selected between 1 and 10 liter/sec. per $m^2$ surface to be cleaned.

5. A method as defined in claim 1 or claim 2 in which the hydrogen atoms are produced by heating an object which does not react with hydrogen in said vessel to a temperature above 1300° C.

6. A method as defined in claim 1 or claim 2, in which the hydrogen atoms are produced by a glow discharge burning in said hydrogen stream resulting in a hydrogen gas containing atomic hydrogen and only low-energy hydrogen ions.

7. A method as defined in claim 1 or claim 2, in which the hydrogen atoms are produced by a high-frequency coil energized to a corona discharge resulting in the formation of atomic hydrogen and only low-energy hydrogen ions in said hydrogen stream.

* * * * *